US010427905B2

(12) United States Patent
Shigehara et al.

(10) Patent No.: US 10,427,905 B2
(45) Date of Patent: Oct. 1, 2019

(54) ACCUMULATION DEVICE

(71) Applicant: Fuji Seal International, Inc., Osaka Osaka-shi (JP)

(72) Inventors: Tsukasa Shigehara, Osaka (JP); Tsutomu Iwakawa, Osaka (JP); Takanori Tanaka, Osaka (JP); Masanobu Tatsumi, Osaka (JP)

(73) Assignee: Fuji Seal International, Inc., Osaka-shi (JP)

( * ) Notice: Subject to any disclaimer, the term of this patent is extended or adjusted under 35 U.S.C. 154(b) by 0 days.

(21) Appl. No.: 15/561,371

(22) PCT Filed: Jan. 28, 2016

(86) PCT No.: PCT/JP2016/052412

§ 371 (c)(1),
(2) Date: Sep. 25, 2017

(87) PCT Pub. No.: WO2016/157972

PCT Pub. Date: Oct. 6, 2016

(65) Prior Publication Data

US 2018/0079615 A1 Mar. 22, 2018

(30) Foreign Application Priority Data

Mar. 27, 2015 (JP) ..... 2015-067329

(51) Int. Cl.
*B65H 23/188* (2006.01)
*B65H 20/34* (2006.01)
(Continued)

(52) U.S. Cl.
CPC ..... *B65H 23/1888* (2013.01); *B65H 20/34* (2013.01); *B65H 23/34* (2013.01);
(Continued)

(58) Field of Classification Search
CPC ..... B65H 20/30; B65H 20/32; B65H 20/34; B65H 23/1888; B65H 23/18; B65H 23/048
See application file for complete search history.

(56) References Cited

U.S. PATENT DOCUMENTS 4,915,282 A 4/1990 Martin et al.
5,190,234 A * 3/1993 Ezekiel ..... B65H 19/14 156/157
(Continued)

FOREIGN PATENT DOCUMENTS

EP 2594515 A2 5/2013
JP 59118645 A 7/1984
(Continued)

OTHER PUBLICATIONS

"International Application No. PCT/JP2016/052412, International Search Report dated Mar. 8, 2016", (Mar. 8, 2016), 5 pgs.
(Continued)

*Primary Examiner* — Michael C McCullough
(74) *Attorney, Agent, or Firm* — Schwegman Lundberg & Woessner, P.A.

(57) ABSTRACT

An accumulation device is provided with a loading unit, a tensioning unit, an accumulation unit, and unloading unit and a controller. The tensioning unit comprises multiple fixed rollers capable of rolling, and movable rollers capable of rolling and arranged so as to be capable of moving with respect to the fixed rollers. Substrates are conveyed so as to move back and forth alternately between the fixed rollers and the movable rollers in a wrapped state, and a prescribed tensile force is applied to the substrates by a force acting on the moveable rollers in the direction away from the fixed
(Continued)

rollers. The controller performs control so as to maintain the positions of the movable rollers in the tensioning unit constant.

15 Claims, 12 Drawing Sheets

(51) Int. Cl.
*B65H 23/34* (2006.01)
*B65H 23/04* (2006.01)

(52) U.S. Cl.
CPC ..... *B65H 23/048* (2013.01); *B65H 2402/631* (2013.01); *B65H 2403/52* (2013.01); *B65H 2403/544* (2013.01); *B65H 2408/217* (2013.01); *B65H 2555/24* (2013.01)

(56) References Cited

U.S. PATENT DOCUMENTS

| | | | | |
|---|---|---|---|---|
| 6,676,062 | B1 | 1/2004 | Herhaus | |
| 2004/0118892 | A1* | 6/2004 | Weber ..... | A61F 13/15772 226/44 |

FOREIGN PATENT DOCUMENTS

| | | | |
|---|---|---|---|
| JP | 6195945 | A | 5/1986 |
| JP | 04197957 | A | 7/1992 |
| JP | 072401 | A | 1/1995 |
| JP | 10310299 | A | 11/1998 |
| JP | 2002338106 | A | 11/2002 |
| JP | 2004123247 | A | 4/2004 |
| JP | 2004276146 | A | 10/2004 |
| JP | 2007062884 | A | 3/2007 |
| JP | 2007161409 | A | 6/2007 |

OTHER PUBLICATIONS

"International Application No. PCT/JP2016/052412, Written Opinion dated Mar. 8, 2016", (Mar. 8, 2016), 6 pgs.
"European Application Serial No. 16 771 587.6, Extended European Search Report dated Nov. 13, 2018", (Nov. 13, 2018), 9 pgs.
"Japanese Appliccation U.S. Appl. No. 2017-509327, Notification of Refusal dated May 30, 2019", w/ English Translation, (May 30, 2019), 15 pgs.

* cited by examiner

STEADY OPERATION STATE

OUTFEED STOP STATE

OUTFEED ACCELERATION STATE

ACCUMULATION DEVICE

PRIORITY APPLICATIONS

This application is a U.S. National Stage Filing under 35 U.S.C. 371 from International Application No. PCT/JP2016/052412, filed on 28 Jan. 2016, and published as WO2016/157972 on 6 Oct. 2016, which claims the benefit of priority to Japanese Application No. 2015-067329, filed on 27 Mar. 2015; which applications and publication are incorporated herein by reference in their entirety.

TECHNICAL FIELD

The present invention relates to an accumulation device capable of accumulating a long belt-like substrate being transported.

BACKGROUND

An accumulation device 100 as illustrated in FIG. 14 is known. The accumulation device 100 may be used for a system designed for applying, to a long belt-like substrate S such as a resin film supplied from a supply reel, predetermined processing such as inspection and machining (e.g., printing, perforating) of the substrate S, and thereafter taking up the substrate S with a winding reel. In such a system, the accumulation device 100 is disposed between a processing device that performs the predetermined processing and a winding unit that winds up the substrate processed by the processing device.

As illustrated in FIG. 14A, the accumulation device 100 includes a plurality of fixed rollers 102 which are arranged in parallel to each other upward in the vertical direction such that they are spaced from each other, and a plurality of movable rollers 104 which are arranged downward in the vertical direction from the respective fixed rollers 102 such that they are spaced from and parallel to each other. Each of the fixed rollers 102 is rotatably supported by a fixed frame (not shown) at its opposite ends. Each of the movable rollers 104, on the other hand, is rotatably supported by a pair of support members 106 (one of which is shown) at its opposite ends. The support member 106 is configured to be capable of ascending and descending toward and away from the fixed rollers 102.

In the accumulation device 100 configured as described above, the substrate S is transported from upstream (the right side in FIG. 14) toward downstream (the left side in FIG. 14) while being wound around each fixed roller 102 and each movable roller 104 alternately. A load F acts on the support member 106 downwardly in the vertical direction. During steady operation in which the substrate S is continuously transported at a constant rate with the load F acting on the support member 106, the substrate S is transported while a constant tensile force is being applied the substrate S.

When a downstream device, such as the winding unit, located downstream of the accumulation device 100, stops for replacement of a reel, for example, outfeed of the substrate S stops downstream of the accumulation device 100 as illustrated in FIG. 14B; however, the substrate S is continuously fed from upstream of the accumulation device 100. In this case, the accumulation device 100 moves the support member 106 supporting the movable rollers 104 away from the fixed rollers 102; that is, downward in the vertical direction (in the direction of arrow G). This allows the substrate S, being continuously fed in with outfeed the substrate S being stopped, to be accumulated in the accumulation device 100.

When the downstream device starts operation to resume outfeed of the substrate S from the accumulation device 100, a substrate outfeed rate by an outfeed roller, which is not shown, is set to be higher than that in steady operation, and, as illustrated in FIG. 14C, the substrate S accumulated in the accumulation device 100 is fed out while the support member 106 supporting the movable rollers 104 is being moved upward. When the support member 106 ascends to a home position in steady operation, the operation state is placed in the steady operation state with the outfeed rate of the substrate S being set to be the same as the infeed rate.

Reference documents related to such an accumulation device include Patent Documents 1 and 2 listed below. The accumulation devices disclosed in these documents are disposed between a substrate feeding device, which is an upstream device, and a labeling device, which is a downstream device. The accumulation devices are capable of continuously transporting a cylindrical label folded in a sheet form to the labeling device at a constant rate while accumulating the label substrate during the steady operation, and continuously feeding out the label substrate accumulated in the accumulation device while infeed of the label substrate is suspended because of replacement of an elongate roll of label substrate of the substrate feeding device, thereby allowing continuous operations of the labeling device.

CITATION LIST

Patent Literature

PATENT DOCUMENT 1: JP 2007-62884 A
PATENT DOCUMENT 2: JP 2007-161409 A

SUMMARY

Technical Problem

In the accumulation device 100 described above, when a predetermined tensile force is to be applied to the substrate S wound around the fixed rollers 102 and the movable rollers 104, the load F acting on the support member 106 supporting the movable rollers 104 increases as the number of movable rollers 104 increases. On the other hand, to secure an extended accumulated length of the substrate in the accumulation device 100, it is necessary to increase the number of the fixed rollers 102 and the movable rollers 104 to extend the length of the substrate S that can be wound between the rollers 104 and 106 during the accumulation operation. This increases the load F acting on the support member 106 accordingly.

When the operation state transitions from the steady operation state illustrated in FIG. 14A to the outfeed stop state illustrated in FIG. 14B with large load F being applied as describe above, in order to accumulate a surplus of the substrate S generated by stopping feeding out the substrate S while continuously feeding in the substrate S, the movable rollers 104 are moved downward to accumulate the substrate, but at this time, the tensile force of the substrate S tends to be smaller than the tensile force during the steady operation. Further, at the time of transition from the outfeed stop state illustrated in FIG. 14B to the outfeed acceleration state illustrated in FIG. 14C, because the substrate S is fed out while setting the outfeed rate of the substrate S to be higher than that in the steady operation in order to return the movable rollers 104 to the height for the steady operation, the movable rollers 104 are moved upward, but the tensile force acting on the substrate S tends to be greater than that in the steady operation. As described above, when the accumulation operation of the substrate S is executed in the accumulation device 100 with large load F acting on each movable roller 104, the tensile force acting on the substrate S fluctuates, which may cause the substrate S to meander or twist, resulting in wrinkles and ruptures on the substrate S. Also, when the fluctuation in the tensile force (especially, a decrease in the tensile force) described above occurs in the substrate S being transported, the substrate S may be loosened with respect to the movable roller 104 located upstream in the transporting direction of the substrate to draw in an air layer, which may also cause meandering of the substrate S, resulting in wrinkles of the substrate S, for example. In particular, a cylindrical label substrate formed by folding a long resin film such that the opposite ends are overlapped and joined together has a large thickness in the joined portion. This would likely cause the substrate S to meander or twist during transportation, thereby causing wrinkles and separation during transportation. A cylindrical label substrate may also expand in a balloon shape because of air accumulated within the cylindrical substrate at a location immediately before each roller around which the substrate is wound, causing a hindrance to transportation of the substrate.

The present invention is aimed at providing an accumulation device capable of regulating fluctuation in a tensile force acting on a long belt-like substrate, when the operation state is switched between a steady operation state in which a substrate S is continuously transported at a constant rate and an accumulation operation state in which the fed-in substrate is accumulated with outfeed of the substrate being stopped, or even when infeed of the label substrate is resumed after infeed of the label substrate is stopped for changing the label roll, while the steady operation is performed with the substrate being accumulated and the substrate is continuously fed out to the labeling device at a constant rate.

Solution to Problem

An accumulation device in accordance with one aspect of the invention includes an infeed unit configured to feed in a substrate having a long belt-like shape, an outfeed unit configured to feed out the substrate, a tensioning unit disposed toward upstream in a transporting direction of the substrate between the infeed unit and the outfeed unit, for applying predetermined tensile force to the substrate, an accumulation unit disposed downstream of the tensioning unit in the transporting direction of the substrate between the infeed unit and the outfeed unit, for accumulating a surplus of the substrate generated by a difference between a substrate infeed rate of the infeed unit and a substrate outfeed rate of the outfeed unit, and a controller configured to control an operation of each of the infeed unit the outfeed unit, and the accumulation unit. The tensioning unit includes a plurality of rotatable fixed rollers spaced from each other and arranged in parallel to each other, and at least one rotatable movable roller disposed in parallel to the fixed rollers. The at least one rotatable movable roller is movable toward and away from the fixed rollers, and the substrate is transported while being wound alternately around the fixed rollers and the movable rollers. The tensioning unit is configured to apply the predetermined tensile force to the substrate by a force acting onto the movable roller in a direction away from the fixed rollers. The controller is configured to maintain a constant position of the movable roller with respect to the fixed rollers of the tensioning unit.

In the above accumulation device, the controller may be configured to control a substrate accumulation operation of the accumulation unit during an accumulation operation, to thereby maintain the constant position of the movable roller with respect to the fixed roller of the tensioning unit.

In the above accumulation device, the controller may be configured to control one of the substrate outfeed rate of the outfeed unit and the substrate infeed rate of the infeed unit during a steady operation, to thereby maintain the constant position of the movable roller with respect to the fixed rollers of the tensioning unit.

In the above accumulation device, the accumulation unit may include a set of first rollers including a plurality of first rollers spaced from each other and disposed in parallel to each other, a set of second rollers including a plurality of second rollers movable toward and away from the set of first rollers and disposed below the set of first rollers, and a drive mechanism configured to cause the set of first rollers and the set of second rollers to perform open and close operations to change a distance between the set of first rollers and the set of second rollers. A substrate may be transported while being wound alternately around the first rollers and the second rollers. Each of the first rollers and the second rollers may include a roller portion, and a shaft configured to rotatably support the roller portion via a bearing member. Each of the first rollers and the second rollers may further include a tendency mechanism configured to rotate the shaft at a rotation rate identical with a rotation rate of the roller portion in a rotation direction identical with a rotation direction of the roller portion.

Advantageous Effects of Invention

As the accumulation device according to an embodiment of the invention includes a tensioning unit for applying a tensile force to a substrate and an accumulation unit for accumulating a surplus of the substrate, which are provided separately, the tensioning unit can apply a desired tensile force to the substrate while applying relatively small load to the substrate. Further, as the controller performs control such that the position of the movable rollers with respect to the fixed rollers in the tensioning unit is maintained, the fluctuation in the tensile force of the substrate caused by movement of the movable rollers with respect to the fixed rollers can be reduced in the tensioning unit. Therefore, even when the operation state is switched between the steady operation state in which a long belt-like substrate is continuously transported at a predetermined rate and the accumulation operation state in which the substrate being fed in is accumulated with outfeed of the substrate being stopped, the fluctuation in the tensile force acting on the substrate can be suppressed. It is also possible to suppress the fluctuation in the tensile force acting on the substrate when the elongate roll that supplies the label substrate to the accumulation unit is changed to feed the label substrate in the accumulation unit once again.

BRIEF DESCRIPTION OF DRAWINGS

FIG. 14A illustrates the steady operation state.

DESCRIPTION OF EMBODIMENTS

Embodiments according to the present invention will be described in detail below with reference to the attached drawings. In the following description, specific shapes, materials, numerical values, and directions, for example, are only examples for facilitating understanding of the present invention, and may be modified as appropriate in accordance with usage, purposes, and specification, for example. When the following description includes a plurality of embodiments and modifications, it is assumed that features thereof are used in appropriate combinations.

The following description describes an example in which a long belt-like substrate to be transported via an accumulation device is a cylindrical resin film in a folded state, which is obtained by joining opposite ends of a printed heat-shrinkable film. However, the substrate is not limited to this example, and may be formed of a material other than a resin film, such as paper, fabric, or metal.

Figure 1:
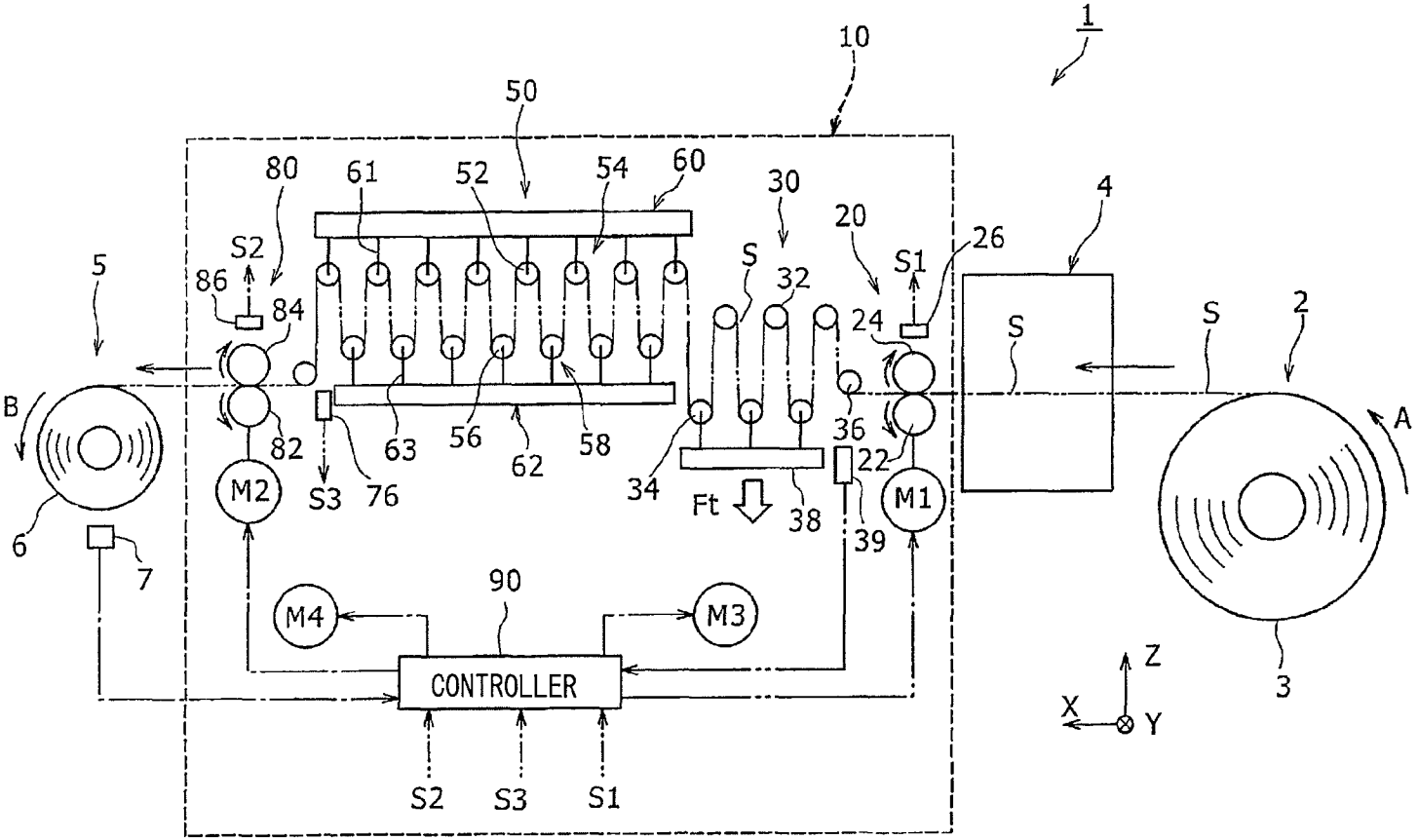
FIG. 1 illustrates a whole structure of a film processing system including an accumulation device according to one embodiment of the present invention.

FIG. 1 illustrates a whole structure of a film processing system 1 including an accumulation device 10 according to one embodiment of the present invention. In FIG. 1 (also in FIG. 2 and other drawings), the horizontal direction along the transportation direction of a substrate S is indicated with an arrow X, the direction orthogonal to the arrow X within the horizontal plane is indicated with an arrow Y, and the vertical direction orthogonal to the arrow X and the arrow Y is indicated with an arrow Z.

The film processing system 1 includes a film supply unit 2 for supplying a substrate S which is a long belt-like resin film, a processor 4 for applying predetermined processing to the substrate S supplied from the film supply unit 2, and a winding unit 5 for taking up the substrate S having been subjected to the predetermined processing via the accumulation device 10.

The film supply unit 2 includes a supply reel 3 wound with the substrate S. The supply reel 3 unreels the substrate S while being driven to rotate in the direction of an arrow A.

The film substrate S unreeled from the supply unit 2 is supplied to the processor 4. The processor 4 applies predetermined processing to the substrate S supplied from the film supply unit 2. The "predetermined processing" as used herein includes, for example, applying image processing to a captured image of the substrate S for inspecting the substrate S, or treating the substrate S by printing and perforating, for example.

The cylindrical substrate S folded in a sheet form, which is supplied from the processor 4, is transported, via the accumulation device 10, to the winding unit 5. The winding unit 5 winds the substrate S by a winding reel 6 which is driven to rotate in the direction of an arrow B. The winding unit 5 includes a substrate winding amount detection sensor 7 disposed at a location opposite the outer circumference of the winding reel 6. The substrate winding amount detection sensor 7 detects that the amount of the substrate S taken up and wound around the winding reel 6 reaches a predetermined amount. The detection value from the substrate winding amount detection sensor 7 is transmitted, as a signal, to a controller 90 of the accumulation device 10.

The accumulation device 10 includes, from upstream to downstream in the transportation direction of the substrate S, an infeed unit 20, a tensioning unit 30, an accumulation unit 50, an outfeed unit 80, and the controller 90, in this order.

The infeed unit 20 has a function to feed the substrate S sent out from the processor 4 into the accumulation device 10. The infeed unit 20 is located closest to the upstream side in the transportation direction of the substrate within the accumulation device 10. The infeed unit 20 includes a drive roller 22 driven to rotate by an infeed motor M1, and a slave roller 24 which forms a nip with the drive roller 22 and can rotate as a slave unit. In the infeed unit 20, the infeed motor M1 is preferably formed of a servo motor, for example. Thus, when the infeed motor M1 drives the drive roller 22 to rotate in the infeed unit 20, the substrate S caught between the drive roller 22 and the slave roller 24 is fed to the tensioning unit 30 of the accumulation device 10.

The infeed unit 20 further includes a rotation rate detection sensor 26 for detecting the rotation rate of the slave roller 24. The detection value from the rotation rate detection sensor 26 is transmitted, as a signal S1, to the controller 90, which can use the signal S1 for computation of the infeed rate of the substrate S. However, when the infeed motor M1 itself has a function to detect the rotation rate and the rotation rate of the drive roller 22 can therefore be derived from the rotation rate of the infeed motor M1, the infeed rate of the substrate S can be calculated based on the rotation rate of the infeed motor M1. Therefore, in such a case, the rotation rate detection sensor 26 may be omitted.

The outfeed unit 80 has a function to feed out the substrate S from the accumulation device 10. The outfeed unit 80 is located closest to the downstream side in the transportation direction of the substrate within the accumulation device 10. The outfeed unit 80 includes a drive roller 82 which is driven to rotate by an outfeed motor M2, and a slave roller 84 which forms a nip with the drive roller 82 and can rotate as a slave unit. In the outfeed unit 80, the outfeed motor M2 is preferably formed of a servo motor, for example. Thus, when the outfeed motor M2 drives the drive roller 82 to rotate in the outfeed unit 80, the substrate S caught between the drive roller 82 and the slave roller 84 is sent out from the accumulation device 10 toward the winding unit 5.

The outfeed unit 80 further includes a rotation rate detection sensor 86 for detecting the rotation rate of the slave roller 84. The detection value from the rotation rate detection sensor 86 is transmitted, as a signal S2, to the controller 90, which can use the signal S2 for computation of the outfeed rate of the substrate S. However, when the outfeed motor M2 itself has a function to detect the rotation rate and the rotation rate of the drive roller 82 can therefore be derived from the rotation rate of the outfeed motor M2, the outfeed rate of the substrate S can be calculated based on the rotation rate of the outfeed motor M2. Therefore, in such a case, the rotation rate detection sensor 86 may be omitted.

The tensioning unit 30 is disposed between the infeed unit 20 and the outfeed unit 80 toward the upstream side with respect to the substrate transportation direction. More specifically, the tensioning unit 30 is disposed next to the infeed unit 20 on the downstream side in the substrate transportation direction.

The tensioning unit 30 includes a plurality of rotatable fixed rollers 32 disposed spaced from and parallel to each other, and a plurality of rotatable movable rollers 34 which are disposed parallel to the fixed rollers 32 and are movable closer to or away from the fixed rollers 32. In the present embodiment, three fixed rollers 32 and three movable rollers 34 are provided. However, the tensioning unit 30 is not limited to this example, and may be configured to include at least two fixed rollers 32 and at least one movable roller 34 disposed at a location below and between these two fixed rollers 32 so as to be movable in the vertical direction or upward and downward directions.

The substrate S sent out from the infeed unit 20 is guided by an outer circumferential surface of a support roller 36 which is rotatably disposed, so that the transportation direction of the substrate S is changed from the horizontal direction to the vertical direction. In the tensioning unit 30, the substrate S winds around the fixed rollers 32 and the movable rollers 34 alternately.

Figure 2:
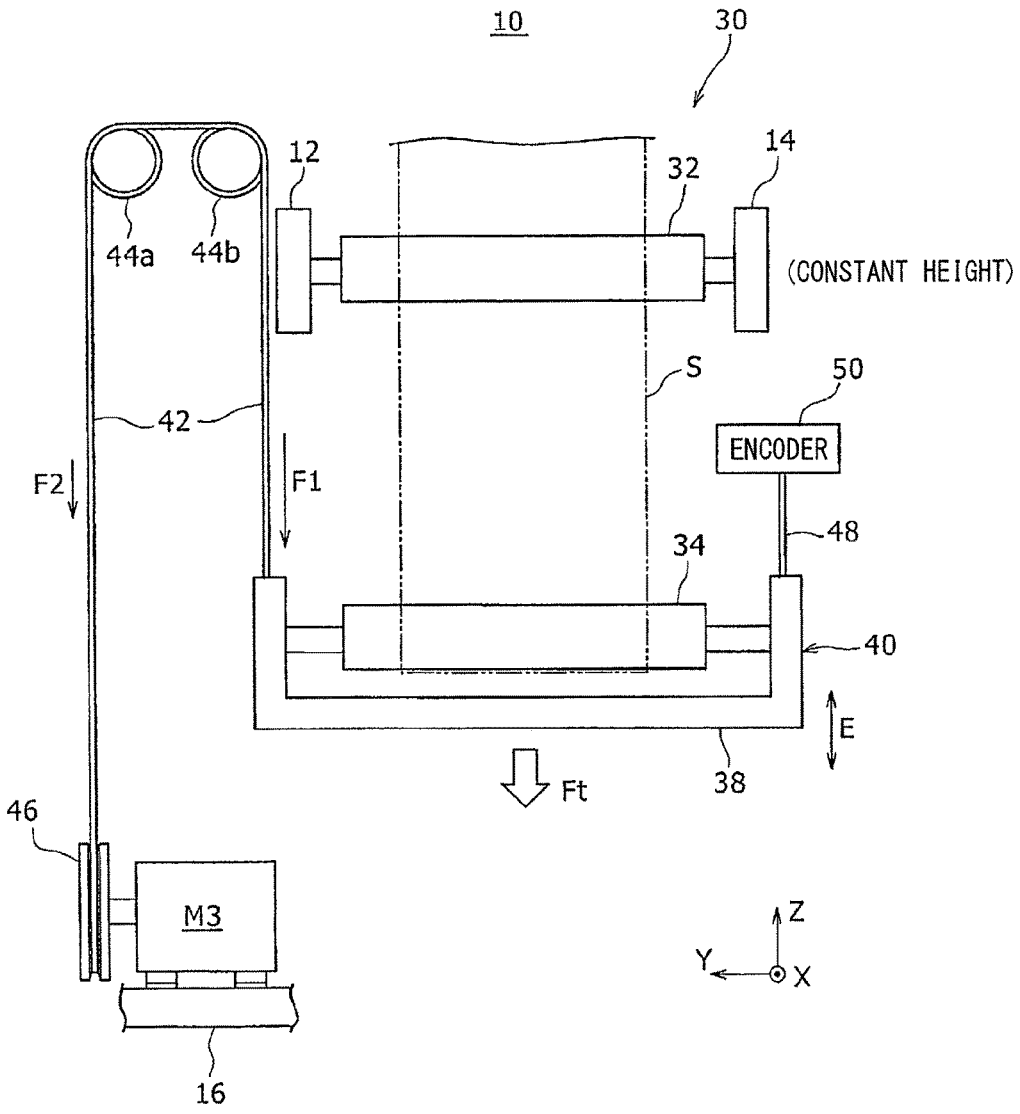
FIG. 2 illustrates a tensioning unit of the accumulation device illustrated in FIG. 1 seen from the downstream side in the substrate transportation direction.

FIG. 2 illustrates the tensioning unit 30 of the accumulation device 10 illustrated in FIG. 1 seen from the downstream side in the substrate transportation direction. Referring to FIG. 1 and FIG. 2, the opposite ends of each fixed roller 32 are rotatably supported by fixed frames 12 and 14 of the accumulation device 10, respectively. Further, the opposite ends of each movable roller 34 are rotatably supported by a support member 38. The support member 38 is disposed so as to be movable along the direction of an arrow E (or the vertical direction Z) by a guide rail, which is not shown, fixed to the accumulation device 10. The movable rollers 34 and the support member 38 form a movable unit 40. In the following description, the movable rollers 34 may be referred to as "dancer rollers."

One end of the support member 38 supporting the movable rollers 34 in the Y direction (width direction) is coupled with one end of a wire 42. The wire 42 extends upward from the one end of the support member 38 and changes the direction to downward via the outer circumferential surface of each of two support pulleys 44*a* and 44*b*. The other end of the wire 42 is wound around a tension pulley 46 coupled to a rotation shaft of a tensile force motor M3. The tensile force motor M3 is fixed to a fixed frame 16 forming the accumulation device 10.

The tensioning unit 30 having the structure described above is configured such that gravity acting on the movable unit 40 in the direction away from the fixed rollers 32 causes predetermined tensile force to be applied to the substrate S. More specifically, in the tensioning unit 30, downward tensile force F1 acts on the one end of the wire 42 due to the weight of the movable rollers 34 and the support member 38. On the other hand, downward tensile force F2 acts on the other end of the wire 42 by controlling the torque of the tensile force motor M3 by the controller 90. The tensile force F2 is set smaller than the tensile force F1. Therefore, during the steady operation in which the substrate S is transported at a predetermined rate, downward load Ft=F1−F2 acts on the movable unit 40, so that a predetermined tensile force is applied to the substrate S which is continuously transported while running between the fixed rollers 32 and the movable rollers 34.

In the present embodiment, torque control of the tensile force motor M3 described above enables rapid and accurate adjustment of the load Ft acting on the movable unit 40. This further facilitates adjustments of desired tensile force when the type of the substrate S (e.g., thickness, materials) is changed. However, the structure in which the predetermined tensile force is applied to the substrate S in the tensioning unit 30 is not limited to the example structure in which a motor for torque control is used. For example, rather than providing the tensile force motor M3, the load Ft may be set only by the self-weight of the movable unit 40, the support member 38 may be weighted so that the load Ft can be adjusted, or a counterweight may be mounted on the other end of the wire 42 to adjust the tensile force F2.

As illustrated in FIG. 1, the tensioning unit 30 includes a height position sensor 39 for detecting the height position of the support member 38 of the movable unit 40. The height position sensor 39 transmits the detection result, as a signal, to the controller 90. The controller 90 performs control to maintain a constant height position of the movable unit 40; that is, a constant height position of the movable rollers 34, based on the detection result from the height position sensor 39, as will be described below.

The height position sensor 39 can be formed by an encoder coupled to the support member 38 for detecting the length of a wire 48 which is fed, as illustrated in FIG. 2. However, the height position sensor 39 is not limited to this example, and may be formed, for example, of other types of sensors such as an optical sensor including a light-emitting element and a light-receiving element, and a contact sensor which contacts the support member 38 to detect the height position of the movable unit 40.

Figure 3:
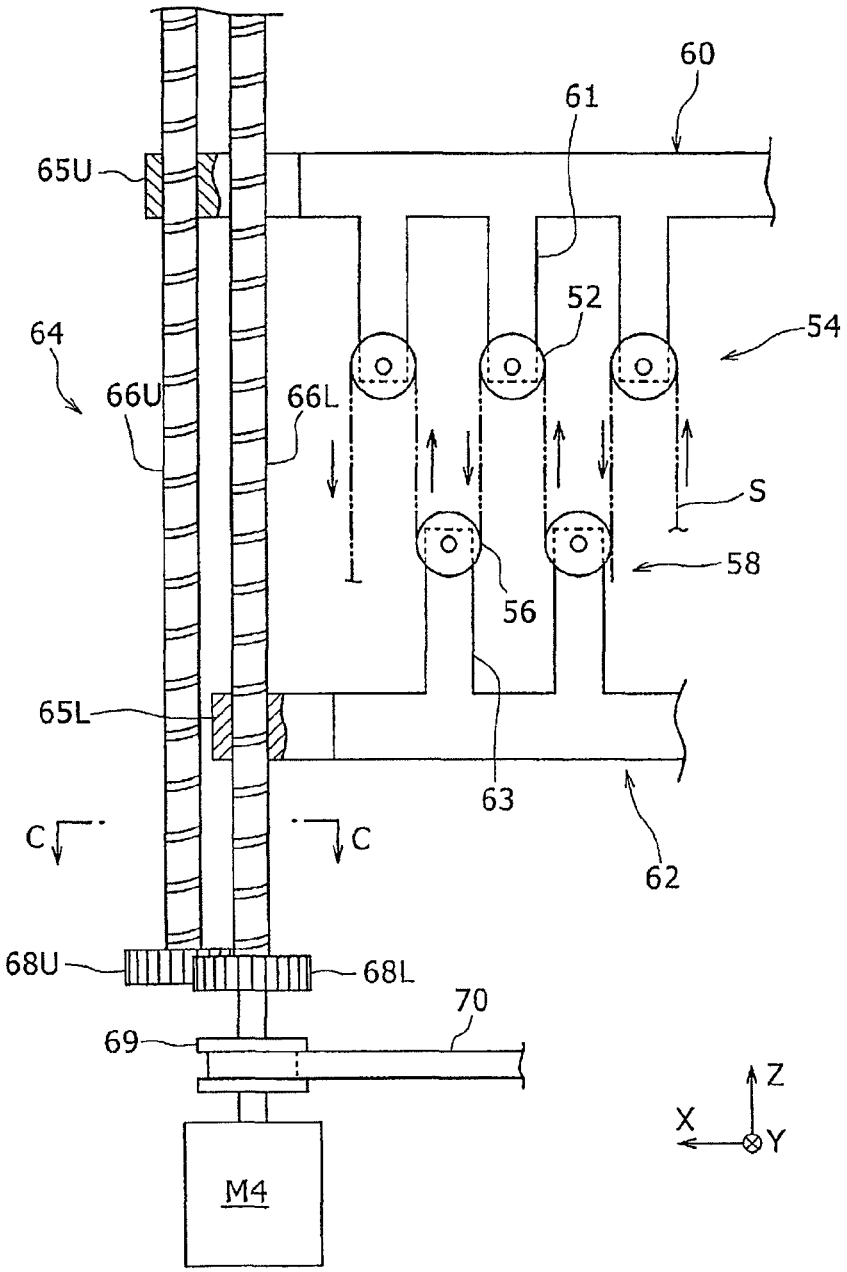
FIG. 3 is a side view illustrating a drive mechanism of an accumulation unit of the accumulation device.
Figure 4:
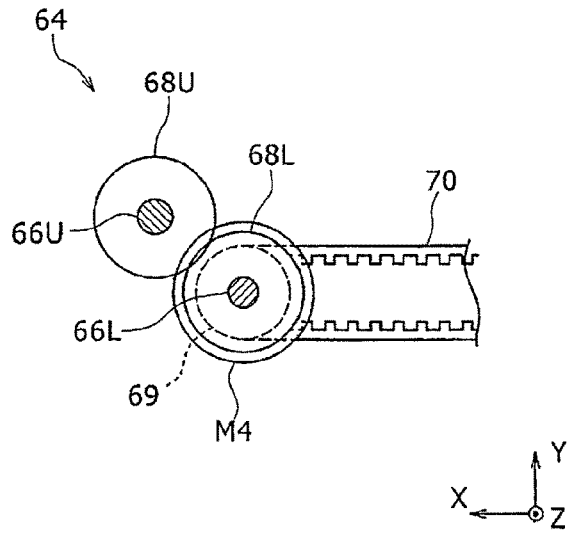
FIG. 4 is a cross sectional view taken along line C-C in FIG. 3 with arrow indication.

Referring now to FIG. 3 and FIG. 4, in addition to FIG. 1, the accumulation unit 50 of the accumulation device 10 will be described. FIG. 3 is a side view illustrating the drive mechanism of the accumulation unit 50. FIG. 4 is a cross sectional view taken along line C-C in FIG. 3 with arrow indication.

As illustrated in FIG. 1, the accumulation unit 50 includes a set of upper rollers (a set of first rollers) 54 including a plurality of rotatable upper rollers (first rollers) 52 spaced from each other and disposed in parallel to each other, and a set of lower rollers (set of second rollers) 58 including a plurality of lower rollers (second rollers) 56 arranged below the set of upper rollers 54 to be movable toward and away from the set of upper rollers 54. In the present embodiment, the accumulation unit 50 includes eight upper rollers 52 and seven lower rollers 56 disposed below the upper rollers 52 at positions corresponding to the intervals between the upper rollers 52. The number of upper rollers 52 and the lower rollers 56 can be modified as appropriate based on the length of the substrate to be accumulated in the accumulation device 10 or the transportation rate of the substrate.

As illustrated in FIG. 1 and FIG. 3, opposite ends of each upper roller 52 are rotatably supported at ends of arm portions 61 projecting in a comb-like shape in a pair of upper support members 60. Further, opposite ends of each lower roller 56 are rotatably supported at ends of arm portions 63 projecting in a comb-like shape in a pair of lower support members 62. In the accumulation unit 50, the substrate S is transported in the directions of arrows while winding around the upper rollers 52 and the lower rollers 56 alternately. FIG. 1 shows only one of the pair of upper support members 60 and one of the pair of lower support members 62.

As further illustrated in FIG. 3, the accumulation unit 50 includes a drive mechanism 64 which causes the set of upper rollers 54 and the set of lower rollers 58 to perform opening and closing operations to thereby change the distance between the set of upper rollers 54 and the set of lower rollers 58. The drive mechanism 64 includes an upper ball screw 66U and a lower ball screw 66L, an upper gear 68U and a lower gear 68L fixed to lower ends of the ball screws 66U and 66L, respectively, a pulley 69 coupled to a lower portion of the lower gear 68L concentrically, and an accumulation motor M4 for driving and rotating the lower gear 68L and the pulley 69.

A nut portion 65U which is integrally formed with the upper support member 60 engages the upper ball screw 66U. Further, a nut portion 65L which is integrally formed with the lower support member 62 engages the lower ball screw 66L. The ball screws 66U and 66L are rotatably supported on a fixed frame of the accumulation device 10 which is not shown, in parallel to each other along the vertical direction. While, for ease of understanding, FIG. 3 (and also FIG. 4) shows the two ball screws 66U and 66L such that they are shifted from each other in the X direction, the two ball screws 66U and 66L may be disposed such that they are aligned in the Y direction.

As illustrated in FIG. 3 and FIG. 4, the pulley 69 coupled to the lower end of the lower ball screw 66L is preferably a timing pulley, and an endless belt 70 to be wound around this pulley 69 is preferably a timing belt. Use of a timing pulley and a timing belt as described above prevents variations in the amount of rotation of the ball screws 66U and 66L caused by slip of the belt, allowing accurate control of the amount of opening and closing operations of the set of upper rollers 54 and the set of lower rollers 58 in the accumulation unit 50.

A drive mechanism having a structure substantially similar to that illustrated in FIG. 3 except the accumulation motor M4 is also provided on the upstream ends of the upper support member 60 and the lower support member 62. The belt 70 is wound around the pulley of the drive mechanism disposed on the upstream ends in the accumulation unit 50. Thus, driving of the pulley 69 to rotate by the accumulation motor M4 causes the upper ball screw 66U and the lower ball screw 66L to be driven to rotate on each of the opposite ends of the accumulation unit 50 in the X direction.

As the accumulation motor M4, a servo motor is preferably used, for example. The accumulation motor M4 is driven to rotate in accordance with instructions from the controller 90. The accumulation motor M4 is fixed to the fixed frame of the accumulation device 10 which is not shown.

As illustrated in FIG. 4, the upper gear 68U and the lower gear 68L engage with each other in the drive mechanism 64. Therefore, driving the lower ball screw 66L to rotate by the accumulation motor M4 results in rotation of the upper ball screw 66U in the reverse direction by the same rotation amount. This causes the sets of lower rollers 58 mounted to the lower ball screw 66L via the nut portion 65L to move downward while causing the set of upper rollers 54 mounted to the upper ball screw 66U via the nut portion 65U to move upward. In other words, the set of upper rollers 54 and the set of lower rollers 58 move away from each other, causing the accumulation unit 50 to perform the opening operation. Consequently, the distance between the set of upper rollers 54 and the set of lower rollers 58 increases to thereby increase the length of the substrate S to be accumulated in the accumulation unit 50.

On the contrary, driving of the ball screws 66U and 66L by the accumulation motor M4 to rotate in the reverse direction causes the set of lower rollers 58 to move upward and causes the set of upper rollers 54 to move downward. In other words, the set of upper rollers 54 and the set of lower rollers 58 move toward each other, causing the accumulation unit 50 to perform the closing operation. Consequently, the distance between the set of upper rollers 54 and the set of lower rollers 58 decreases to thereby reduce the length of the substrate S to be accumulated in the accumulation unit 50.

The accumulation unit 50 according to the present embodiment is configured such that, with the upper gear 68U coupled to the upper ball screw 66U and the lower gear 68L coupled to the lower ball screw 66L being engaged with each other, the single accumulation motor M4 drives the ball screws 66U and 66L to rotate. This configuration allows the torque acting on the upper ball screw 66U for supporting the total weight of the set of upper rollers 54 and the upper support member 60 and the torque acting on the lower baller screw 66L for supporting the total weight of the set of the lower rollers 58 and the lower support member 62 to work in directions cancelling each other in the engagement portion of each of the gears 68U and 68L. Therefore, the two ball screws 66U and 66L can be rotated with a light torque, which leads to an advantage that the accumulation motor M4 which is small and inexpensive can be used.

Figure 5:
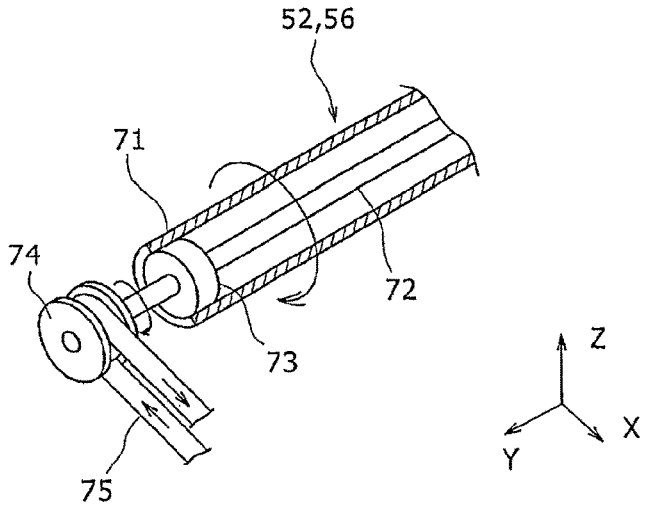
FIG. 5 is a perspective view illustrating a tendency mechanism disposed on each roller of the accumulation unit.
Figure 6:
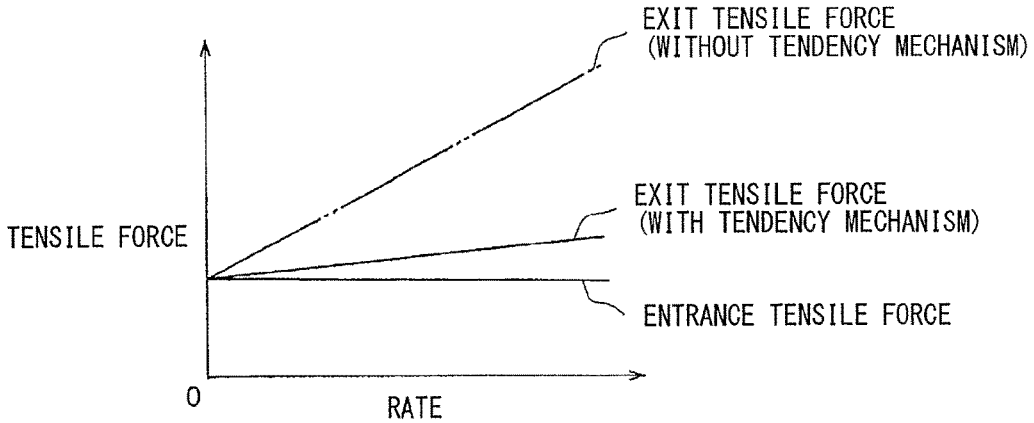
FIG. 6 is a graph showing a tendency of the tensile force acting on the substrate in the accumulation unit.

FIG. 5 is a perspective view illustrating a tendency mechanism provided on each roller of the accumulation unit 50. Further, FIG. 6 is a graph showing the tendency of the tensile force acting on the substrate S in the accumulation unit 50. In the accumulation unit 50 according to the present embodiment, the upper rollers 52 and the lower rollers 56 preferably include a tendency mechanism illustrated in FIG. 5. In this tendency mechanism, a roller portion 71 of each of the rollers 52 and 56 is rotatably supported, on an inner circumferential surface, by a bearing member 73 fixed to a shaft 72. A pulley 74 is attached to an end of the shaft 72 protruding beyond the roller portion 71, and a belt 75 is wound around this pulley 74. This configuration enables the shaft 72 to rotate at the same rotation rate as that of the roller portion 71 in the same direction by driving the belt 75 to rotate by a motor which is not shown, when the roller portion 71 of each of the rollers 52 and 56 rotates with running of the substrate S. This results in substantial cancellation of mechanical rotational resistance caused by the bearing member 73, thereby preventing an increase in the tensile force of the substrate S caused by accumulative addition of the mechanical rotational resistances of a plurality of upper rollers 52 and lower rollers 56 in the accumulation unit 50.

More specifically, as illustrated in FIG. 6, the tensile force of the substrate S at an entrance (upstream side) of the accumulation unit 50 is constant according to the predetermined tensile force applied by the tensioning unit 30. When each of the rollers 52 and 56 of the accumulation unit 50 includes no tendency mechanism, cumulative addition of the mechanical rotational resistance of the bearing members of the rollers 52 and 56 leads to a tendency of the tensile force of the substrate S at the exit (downstream side) of the accumulation unit 50 to increase in proportion to the transportation rate of the substrate S, as shown by a dashed and double-dotted line in FIG. 6. This tendency becomes particularly noticeable when the transportation rate of the substrate S is high, such as several hundreds of meters per minute. The tendency mechanism mounted in the rollers 52 and 56 according to the present embodiment can suppress the increase in the tensile force of the substrate S caused by the mechanical rotational resistance of the bearing member at the exit of the accumulation unit 50. Thus, the tendency mechanism, along with the effects obtained by control of the tensioning unit 30 and the accumulation unit 50 as will be described below, can contribute to suppression of fluctuation in the tensile force of the substrate S in the accumulation device 10.

Referring back to FIG. 1, the accumulation unit 50 further includes a home position sensor 76 for detecting the height position of the lower support member 62. The home position sensor 76 has a function to detect whether the lower support member 62 and the set of lower rollers 58 are at a predetermined height position in the steady operation state. For the home position sensor 76, a sensor, such as a potentiometer and a linear encoder, may be used. The detection result of the home position sensor 76 is transmitted, as a signal S3, to the controller 90.

As illustrated in FIG. 1, the controller 90 preferably includes a microcomputer including a CPU (Central Processing Unit) for executing control programs and a storage device such as a ROM (Read Only Memory) and a RAM (Random Access Memory) for storing control programs and detection data of each sensor, for example. The controller 90 receives signals from the sensors 7, 26, 39, 76, and 86. The controller 90 further transmits signals to each of the motors M1, M2, M3, and M4 to control the operation of each motor. The controller 90 may further include an operation panel (not shown). The operator can use the operation panel to instruct operation and stop of the system 100, setting of the substrate transportation rate, and the like.

Figure 7:
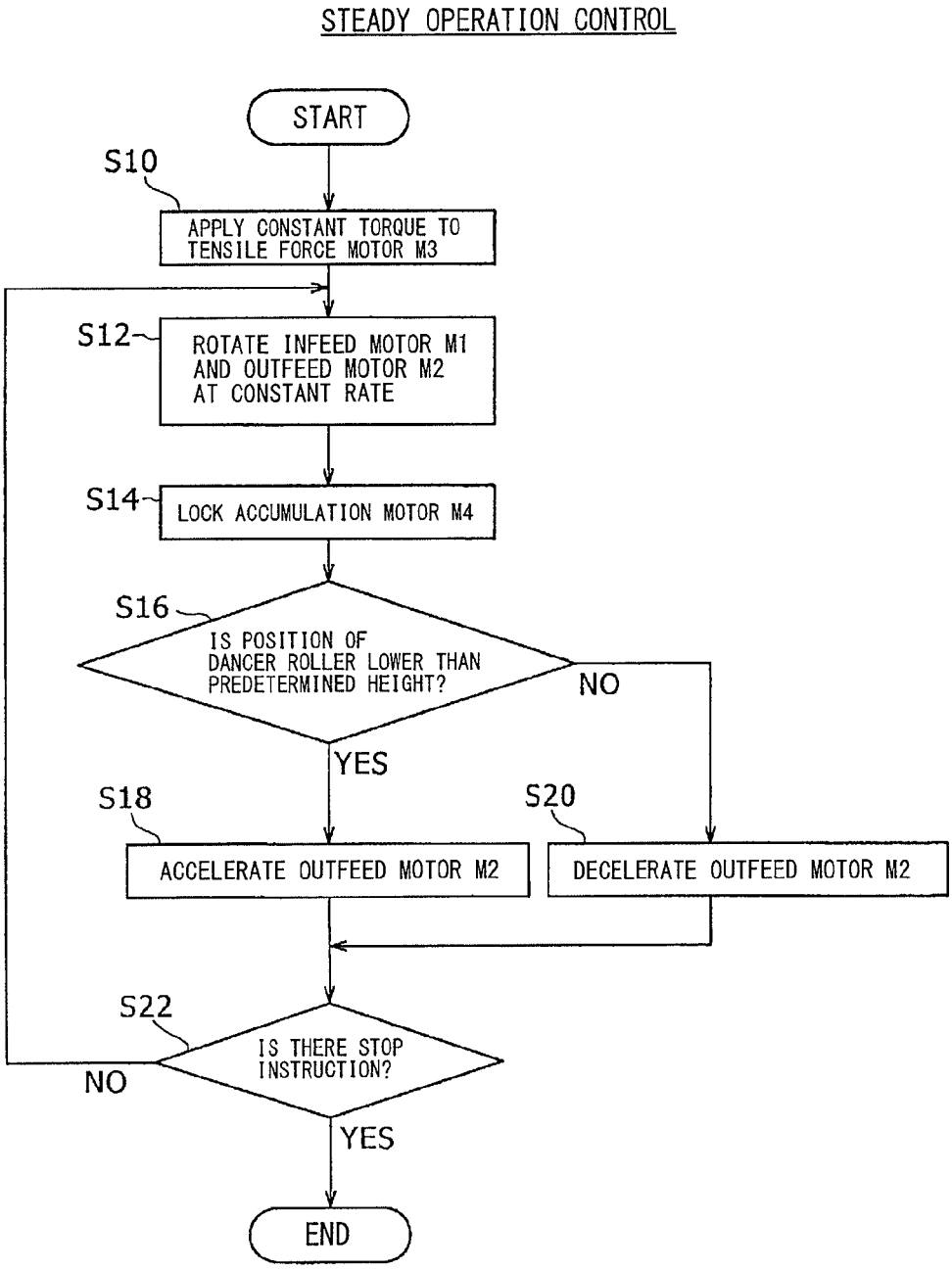
FIG. 7 is a flowchart showing steady operation control executed by a controller illustrated in FIG. 1.
Figure 8:
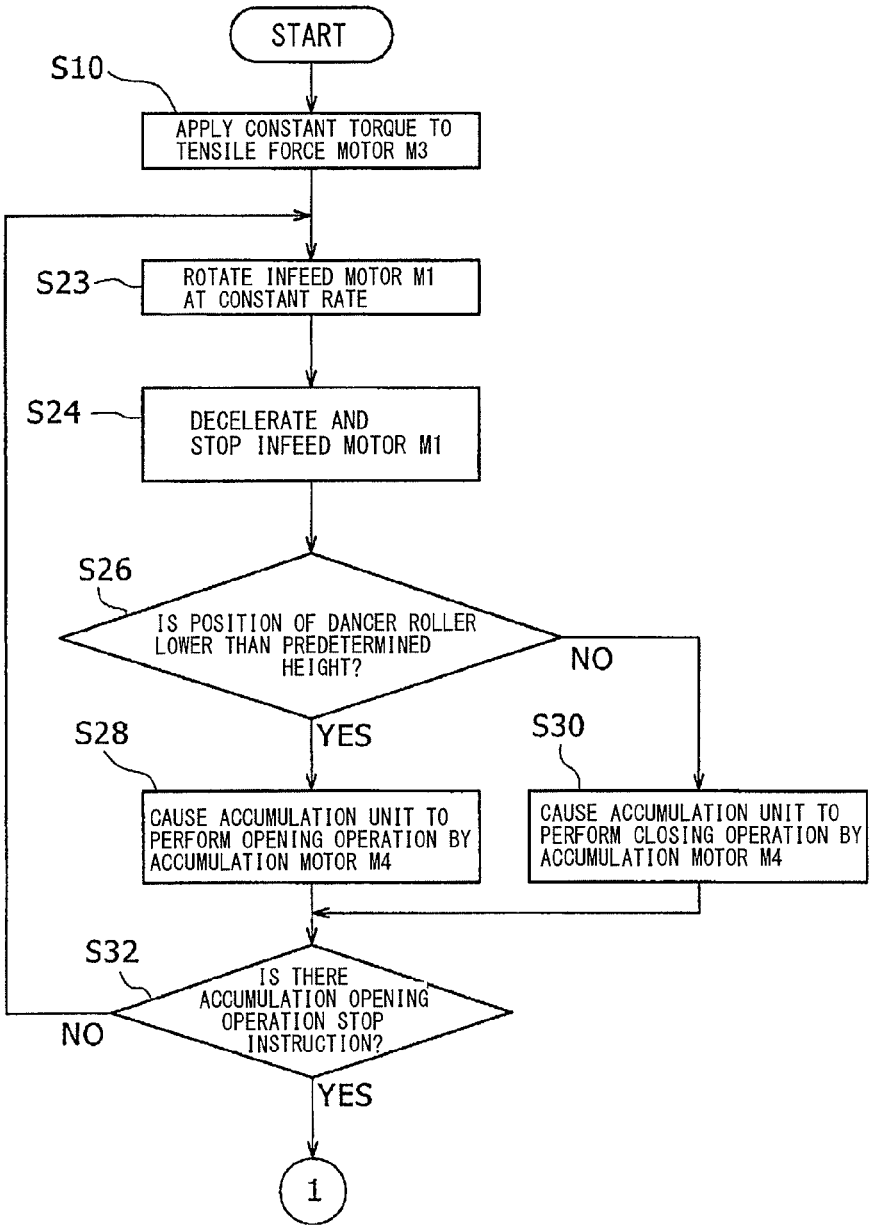
FIG. 8 is a flowchart showing accumulation operation control executed by the controller illustrated in FIG. 1.
Figure 9:
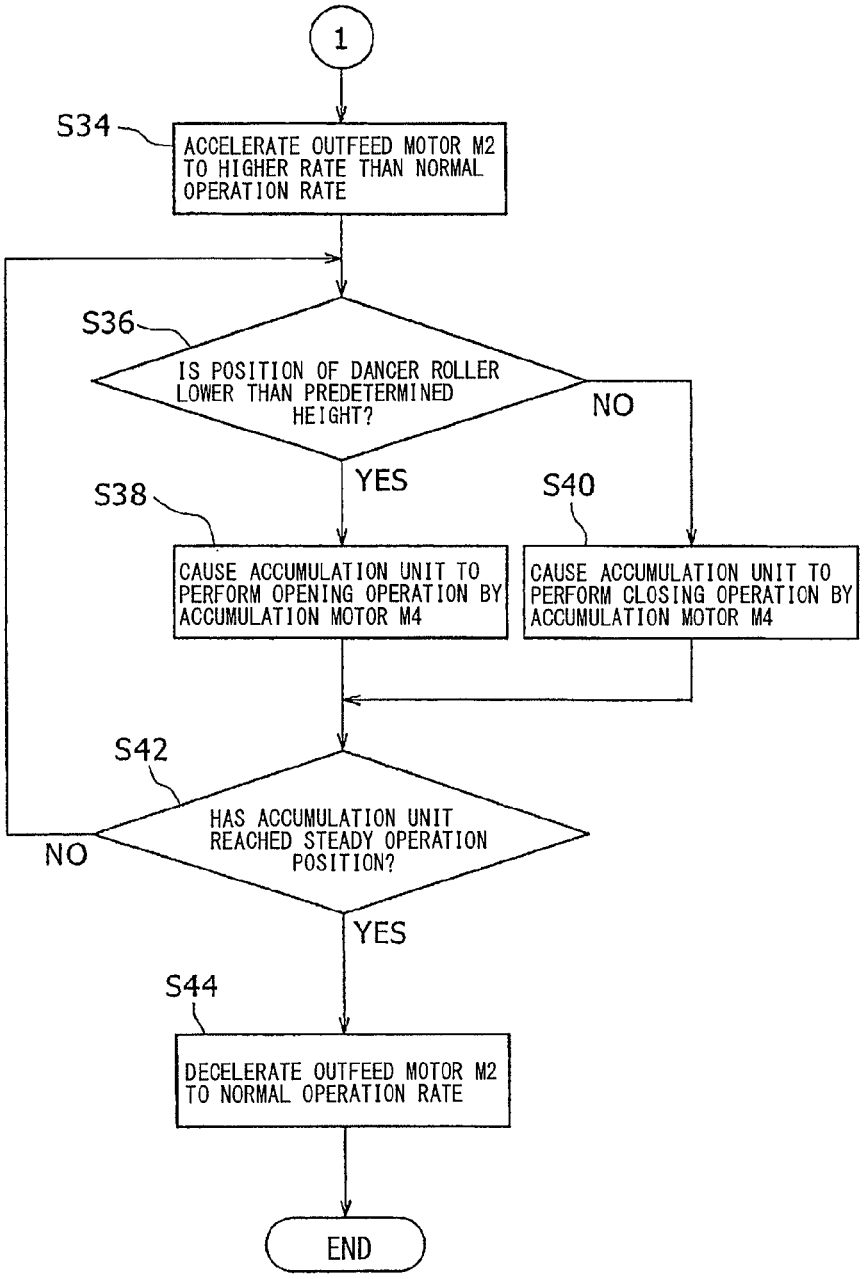
FIG. 9 is a flowchart showing the accumulation operation control continuing from FIG. 8 executed by the controller illustrated in FIG. 1.
Figure 10:
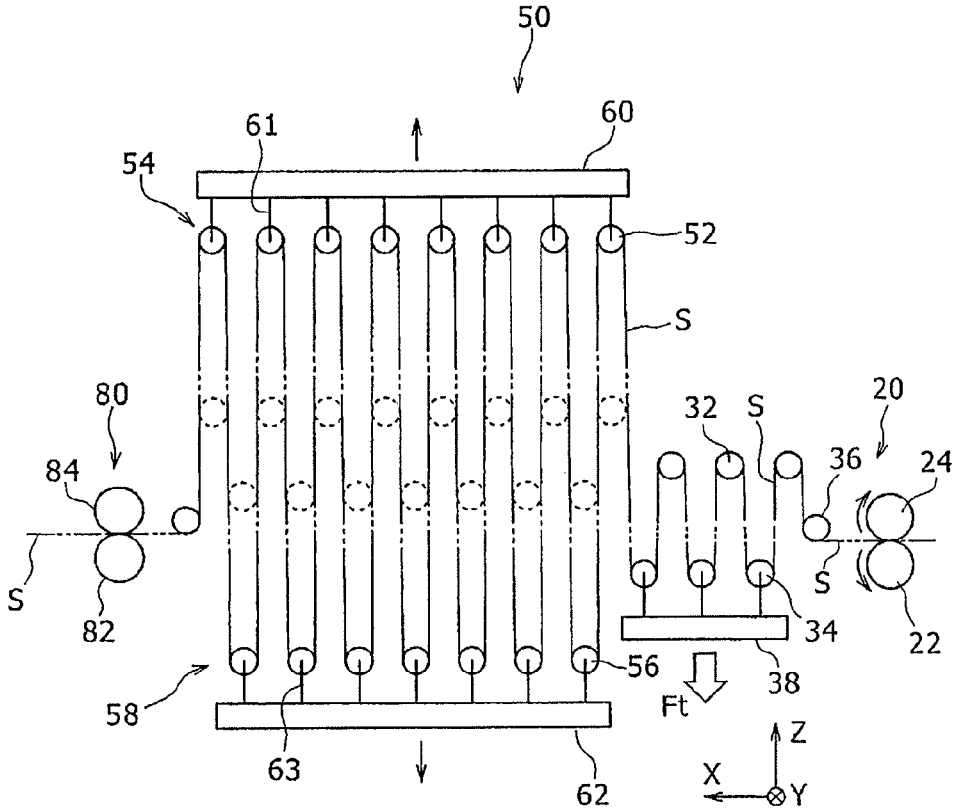
FIG. 10 is a diagram illustrating the accumulation operation state in the accumulation device.

Referring further to FIG. 7 to FIG. 10, control of the accumulation device 10 as configured above will be described. FIG. 7 is a flowchart showing processing for steady operation control which is executed in the controller 90 illustrated in FIG. 1. FIG. 8 is a flowchart showing processing for accumulation operation control which is executed by the controller 90. FIG. 9 is a flowchart showing the processing for accumulation operation control which is executed by the controller 90 continuously from FIG. 8. Further, FIG. 10 illustrates the accumulation operation state in the accumulation device 10.

Referring first to FIG. 7, the steady operation control for the accumulation device 10 will be described. In step S10, the controller 90 performs control to apply a predetermined torque to the tensile force motor M3. This allows the tensioning unit 30 to apply a desired tensile force to the substrate S while the substrate S is continuously transported at a predetermined rate (e.g., several hundreds of meters per minute) by the infeed unit 20 and the outfeed unit 80.

In step S12, the controller 90 then places the infeed motor M1 of the infeed unit 20 and the outfeed motor M2 of the outfeed unit 80 in synchronism with each other and drives these motors to rotate at a predetermined constant rate. Consequently, the substrate S sent out from the film supply unit 2 in the film processing system 1 and subjected to predetermined processing in the processor 4 is transported at the constant rate via the accumulation device 10 and is wound by the winding unit 5.

Then, in step S14, the controller 90 locks the accumulation motor M4 in the accumulation unit 50. Specifically, in this state, the set of upper rollers 54 and the set of lower rollers 58 are maintained in a predetermined positional relationship in which the set of upper rollers 54 and the set of lower rollers 58 are close to each other in the accumulation unit 50.

In step S16, the controller 90 then determines whether the position of the dancer rollers; that is, the position of the movable rollers 34 of the tensioning unit 30, is lower than a predetermined height. The determination is performed based on the signal supplied from the height position sensor 39 in the tensioning unit 30. If an affirmative determination is made (YES in step S16), the outfeed motor M2 is accelerated in the following step S18. As this prevents the opening and closing operation of each set of rollers 54 and 58 in the accumulation unit 50, the acceleration of the outfeed motor M2 causes the movable roller 34 in the tensioning unit 30 to move upward. On the other hand, if a negative determination is made in step S16 described above; that is, if it is determined that the position of the dancer rollers is not lower than the predetermined height, the outfeed motor M2 is decelerated in step S20.

In the subsequent step S22, the controller 90 determines whether or not there is a stop instruction for the steady operation. The stop instruction for the steady operation is generated by the controller 90 based on a detection signal from the substrate winding amount detection sensor 7 which detects the winding amount of the substrate S by the winding reel 6 reaching the predetermined amount, for example. The stop instruction for the steady operation is also generated when an operation to stop the film processing system 1 itself is performed.

If a negative determination is made in step S22 described above (NO in step S22), processes in steps S12 to S22 are repeated. This allows the substrate S to be continuously transported through the accumulation device 10 with the predetermined tensile force applied to the substrate S by the tensioning unit 30 and with the movable rollers 34 being maintained at a constant height. If, on the other hand, it is determined that there is a stop instruction for the steady operation in step S22 (YES in step S22), the controller 90 terminates the steady operation control.

Referring now to FIG. 8 and FIG. 9, the accumulation operation control for the accumulation device 10 will be described. This control is executed when replacing the winding reel automatically or manually based on the detection result from the substrate winding amount detection sensor 7 of the winding unit 5.

As illustrated in FIG. 8, in step S10, the controller 90 performs control to apply constant torque to the tensile force motor M3. This processing is the same as the processing in the steady operation control described above.

The controller 90 then causes the infeed motor M1 to rotate at the constant rate of the steady operation state in step S23, while causing the outfeed motor M2 to decelerate and stop in step S24. This causes the substrate S to be continuously fed in but prevents the substrate S from being fed out in the accumulation device 10.

In step S26, the controller 90 determines whether or not the position of the dancer rollers; that is, the height position of the movable rollers 34 of the tensioning unit 30, is lower than the predetermined height. This determination is made based on a signal from the height position sensor 39 of the tensioning unit 30. If an affirmative determination is made (YES in step S26), in step S28, the accumulation motor M4 is driven in the forward direction to cause the accumulation unit 50 to perform the opening operation. This control causes the set of upper rollers 54 to move upward and the set of lower rollers 58 to move downward in the accumulation unit 50, as illustrated in FIG. 10. As a result, a surplus of the substrate S generated by continuously feeding in the substrate while stopping feeding out the substrate can be absorbed and accumulated by the opening operation of the accumulation unit 50. Therefore, the tensioning unit 30 can maintain the movable rollers 34 at a constant height position, to thereby maintain the state in which a predetermined tensile force is applied to the substrate S.

In the following step S32, the controller 90 determines whether or not there is an accumulation opening operation termination instruction. The accumulation opening operation termination instruction may be generated by the controller 90 when, for example, it is detected based on the signal from the substrate winding amount detection sensor 7 that the winding reel has been replaced in the winding unit 5 to allow resumption of winding of the substrate S, or may be generated by the controller 90 when the operator performs an operation to terminate replacement of the winding reel.

If in step S32 it is not determined that there is an accumulation opening operation termination instruction (NO in step S32), the controller 90 repeats the steps S23 to S32. During this period, if the position of the dancer rollers is not determined to be lower than the predetermined height in step S26 (NO in step S26), in step S30, the accumulation motor M4 is driven in the reverse direction to cause the accumulation unit 50 to perform the closing operation. However, because the opening operation is performed such that the predetermined maximum position is reached in the accumulation unit 50 while the accumulation operation; that is, the substrate accumulation operation is continued, the processing in step S30 described above is rarely performed.

If it is determined in step S32 that there is an accumulation opening operation termination instruction (YES in step S32), the controller 90 accelerates the outfeed motor M2 to achieve the rate which is higher than the steady operation (e.g., 1.2 times the steady operation rate) in step S34, as illustrated in FIG. 9.

In the following step S36, the controller 90 determines whether or not the position of the dancer rollers is lower than the predetermined height. This determination is similar to those in steps S16 and S26 described above. If an affirmative determination is made (YES in step S36), in step S38, the accumulation motor M4 is driven in the forward direction to cause the accumulation unit 50 to perform the opening operation. In this case, however, because the outfeed rate of the substrate S in the outfeed unit 80 is set to be higher than the infeed rate in the infeed unit 20, in most cases, the position of the dancer rollers is not lower than the predetermined height; that is, higher than the predetermined height in the determination in step S36. Therefore, in this case, a negative determination is made in step S36, and, in the following step S40, the accumulation motor M4 is driven in the reverse direction to cause the accumulation unit 50 to perform the closing operation. Specifically, the set of upper rollers 54 is moved downward and the set of lower rollers 58 is moved upward, so that the upper and lower rollers are moved toward each other.

In step S42, the controller 90 determines whether the accumulation unit 50 reaches the steady operation position. This determination is made based on a detection signal from the home position sensor 76 that detects the height position of the lower support member 62 for supporting the set of lower rollers 58. If a negative determination is made (NO in step S42), the steps S36 to S42 are repeated. On the other hand, if it is determined that the accumulation unit 50 has returned to the steady operation position (YES in step S42), in step S44, the outfeed motor M2 is decelerated to the steady operation rate. More specifically, in this state, the infeed motor M1 and the outfeed motor M2 are driven at the same rate, and the operation state is shifted to the steady operation state in which the substrate S is continuously transported at the predetermined rate.

As described above, because the accumulation device 10 according to the present embodiment includes the tensioning unit 30 for applying tensile force to the substrate S and the accumulation unit for accumulating a surplus of the substrate, generated by continuously feeding in the substrate while stopping feeding out the substrate, as separate units, the tensioning unit can apply desired tensile force to the substrate S while applying relatively small load Ft to the substrate S. Further, in order to maintain the movable rollers 34 at the constant height position with respect to the fixed rollers 32 in the tensioning unit 30, the controller 90 controls the substrate outfeed rate of the outfeed unit 80 during the steady operation, and controls the opening and closing operation of the accumulation unit 50 during the accumulation operation. This control can reduce the fluctuation in the tensile force of the substrate S caused by movement of the movable rollers 34 with respect to the fixed rollers 32 in the tensioning unit 30. Therefore, even when the operation state switches between the steady operation state in which a long belt-like substrate S is continuously transported at the predetermined rate and the accumulation operation state in which the substrate S which is fed in is accumulated while outfeed the substrate S is being stopped, the fluctuation in the tensile force acting on the substrate S can be reduced. This can prevent meandering and looseness of the substrate S caused by the fluctuation in the tensile force, thereby reducing generation of resulting wrinkles and breakages of the substrate S.

Figure 11:
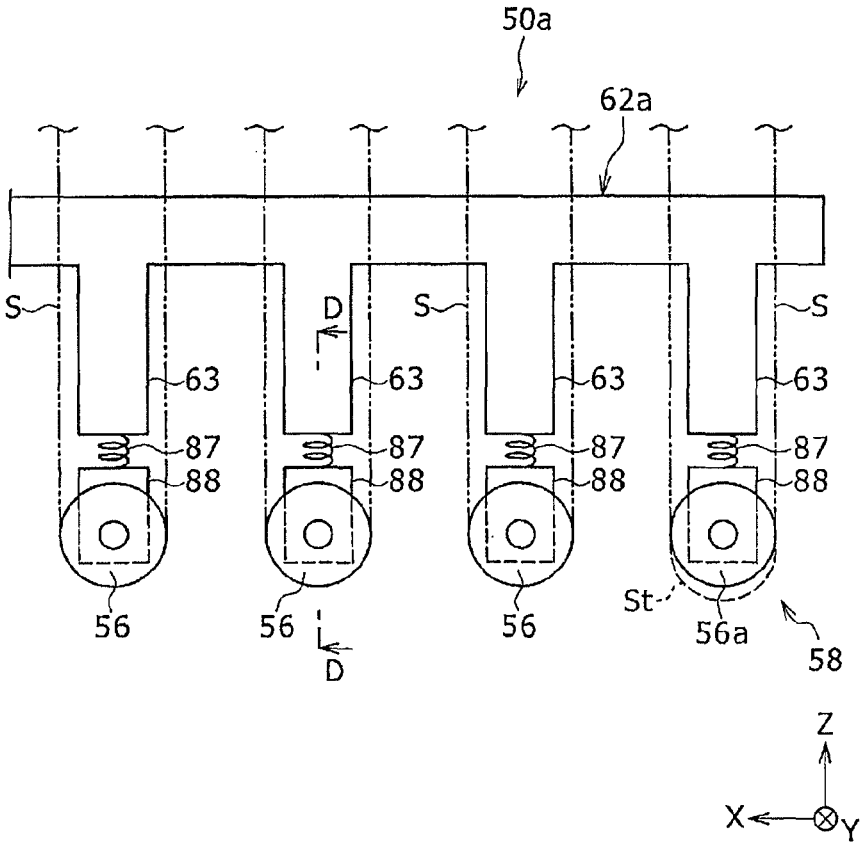
FIG. 11 is a diagram illustrating a modification example accumulation device including independent suspension lower rollers in the accumulation unit.
Figure 12:
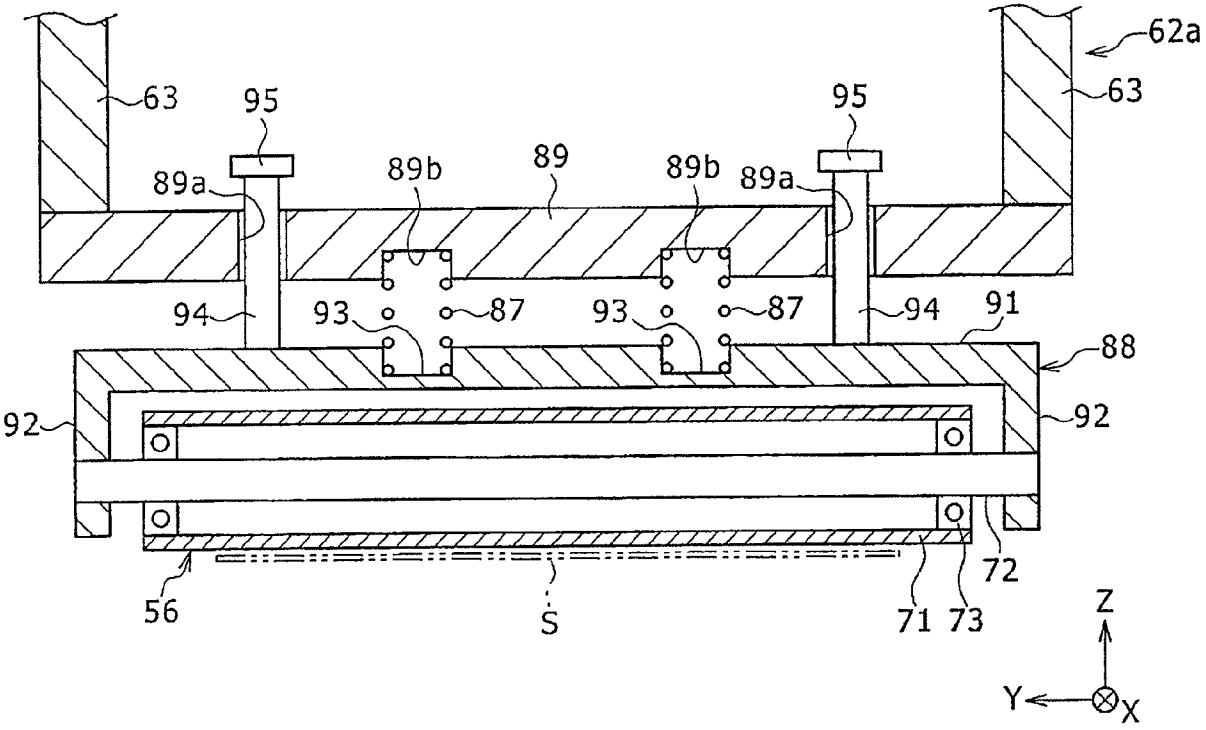
FIG. 12 is a cross sectional view taken along line D-D in FIG. 11.
Figure 13:
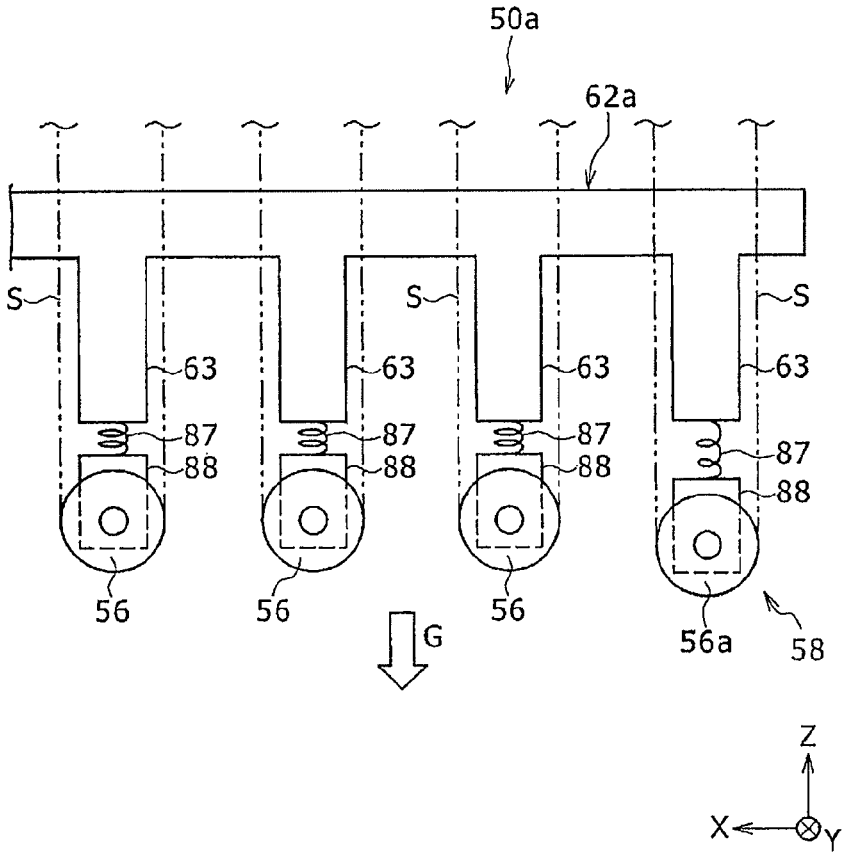
FIG. 13 is a diagram illustrating a state in which the modification example accumulation unit illustrated in FIG. 11 performs the accumulation operation.

Referring further to FIG. 11 to FIG. 13, a modification example support structure for the lower rollers 56 will be described. FIG. 11 illustrates a modification example accumulation device in which an accumulation unit 50*a* includes independent suspension lower rollers 56. FIG. 12 is a cross sectional view taken along line D-D in FIG. 11.

As illustrated in FIG. 11, each of a pair of lower support members 62*a* in this modification example includes comb-like arm portions 63 which rotatably support the respective lower rollers 56 and formed projecting downward (-Z direction). Each of the lower rollers 56 is coupled to the tip end portion of the respective arm portion 63 via an elastic member 87. The drive mechanism 64 for lifting and lowering the pair of lower support members 62*a* is similar to that described in the above example.

As illustrated in FIG. 12, a coupling member 89 is disposed on the lower end of each arm portion 63 with a bolt fastener, for example, in the pair of lower support members 62*a*. The coupling member 89 includes two through holes 89*a* spaced in the Y direction. The coupling member 89 further includes, on a lower surface, two recess portions 89*b* each housing an end of a coil spring which will be described below.

A movable member 88 is mounted on the coupling member 89 disposed between the arm portions 63 of the pair of lower support members 62*a*. A plurality of shaft members 94 are provided vertically on a top surface of the movable member 88 such that the shaft members 94 are inserted through the corresponding through holes 89*a* of the coupling member 89. A stopper 95 having a larger diameter than the through hole 89*a* is disposed on the upper end of the shaft member 94. This structure can support the movable member 88 in a manner movable in the vertical direction with respect to the coupling member 89 (that is, the pair of lower support members 62*a*). The stopper 95 regulates the movable length of the movable member 88 in the vertical direction.

The movable member 88 includes two side wall portions 92 suspended at opposite ends thereof in the Y direction. The lower roller 56 is rotatably supported between these side wall portions 92. More specifically, the lower roller 56 includes a shaft 72 serving as a rotation center axis, and a cylindrical roller portion 71 rotatably supported by two bearing members 73 fixed to opposite ends of the shaft 72, and the shaft 72 is fixed to the two side wall portions 92 of the movable member 88 at the respective ends. This structure allows the lower roller 56 to be rotatably supported by the movable member 88.

The movable member 88 includes, on a top surface thereof, two recess portions 93 formed to oppose the recess portions 89*b* of the coupling member 89, respectively. A coil spring forming the elastic member 87 is disposed between the coupling member 89 and the movable member 88. Each of the two coil springs forming the elastic member 87 is positioned with the respective ends being fitted into the recess portions 89*b* and 93 of the coupling member 89 and the movable member 88, respectively.

FIG. 12 illustrates the steady operation state in which the substrate S is continuously transported at a constant rate in the accumulation unit 50*a*. During the steady operation state, predetermined tensile force acts on the substrate S being transported, so that the movable member 88 supporting the lower roller 56 is lifted against the urging force of the elastic member 87. Specifically, the coil spring which is the elastic member 87 is in a compressed state and urges the lower roller 56 downward.

While a coil spring is used as the elastic member 87 in this modification example, the elastic member is not limited to this example, and any other elastic member that generates downward urging force with respect to the lower rollers 56, such as a flat spring or an air spring, may be used.

Further, while in this modification example, the lower roller 56 is urged by the elastic member 87, this is not limited to this example, and the lower roller 56 may be urged with respect to the substrate S only by the self-weight of the lower rollers 56 and the movable member 88. In this case, the elastic member 87 and the recess portions 89*b* and 93 can be omitted.

Referring to FIG. 13 in addition to FIG. 11, the operation of the modification example accumulation unit 50*a* will be described. FIG. 13 illustrates a state in which the accumulation unit 50*a* illustrated in FIG. 11 performs the accumulation operation.

As illustrated in FIG. 11, when the accumulation unit 50*a* is in the steady operation state, the infeed unit 20 and the outfeed unit 80 are driven at the same rate, so that the substrate S is transported at a constant rate while the set of lower rollers 58 including a plurality of lower rollers 56 is maintained at a certain height position in the accumulation unit 50*a*. At this time, the tensile force acting on the substrate S places each of the lower rollers 56 in a lifted state against the urging force of the elastic member 87 as described above.

When the operation of a downstream device disposed on the downstream in the substrate transporting direction of the accumulation device 10 is interrupted, as illustrated in FIG. 10, an instruction from the controller 90 causes the outfeed unit 80 to reduce the rotation rate and stop and simultaneously causes the infeed unit 20 to continuously feed in the substrate S at the same rate as that in the steady operation. Thus, the difference between the outfeed rate of the substrate S by the outfeed unit 80 and the infeed rate by the infeed unit 20 generates a surplus of the substrate S. To absorb the surplus of the substrate S, the accumulation unit 50*a* of the accumulation device 10 performs the accumulation operation.

More specifically, when the outfeed unit 80 starts decelerating, in order to accumulate the resulting surplus of the substrate S, the set of upper rollers 54 moves upward and the set of lower rollers 58 moves downward in the direction of arrow Gas illustrated in FIG. 13. This results in an increase in the distance between the set of upper rollers 54 and the set of lower rollers 58, so that the surplus of the substrate S is absorbed and accumulated in the accumulation unit 50*a*. At this time, the set of lower rollers 58 can be lowered to the predetermined height position which is separated from the set of upper rollers 54 by the maximum distance, and the downward urging force by the elastic member 87 continuously acts on the lower rollers 56 until the lower rollers 56 reach the predetermined height position, and after the lower rollers 56 have reached the predetermined height position. Unless the tensile force acting on the substrate S fluctuates, the compression amount of the elastic member 87 does not change and therefore the urging force by the elastic member 87 is constant.

During this accumulation operation, no problems would arise when the operation to move each lower roller 56 downward by the drive mechanism 64 (see FIG. 3) is performed such that no fluctuation in the tensile force is caused in the substrate S. However, when the responsiveness of the accumulation operation is slightly slow, as described above with reference to FIG. 11, the substrate S may be loosened and float off momentarily with respect to one or more lower rollers 56*a* located upstream in the substrate transporting direction (the right side in FIG. 11). This state is illustrated with dashed line St in FIG. 11. Such a phenomenon in which the substrate S is loosened and floats off becomes more noticeable when the transportation rate of the substrate S is high, such as several hundreds of meters per minute. When such looseness is generated even momentarily, the substrate S may meander, leading to formation of wrinkles on the substrate S to be wound.

To the contrary, the modification example accumulation unit 50*a* adopts an "independent suspension system" in which each lower roller 56 is supported while being urged downward independently by the elastic member 87. Even when fluctuation of the tensile force occurs in the substrate S during the accumulation operation as described above, and the fluctuation of the tensile force causes the substrate S to float off the lower roller 56, this structure enables each lower roller 56, particularly one or more lower rollers 56*a* located upstream in the transporting direction of the substrate, to follow the movement of the substrate S and move downward by its self-weight and the urging force of the elastic member 87. This allows the lower rollers 56 to remain in contact with the substrate S, to thereby prevent formation of an air layer between the substrate S and the lower rollers 56 and to effectively reduce occurrence of meandering of the substrate S and the resulting wrinkles of the substrate S.

Figure 14A:
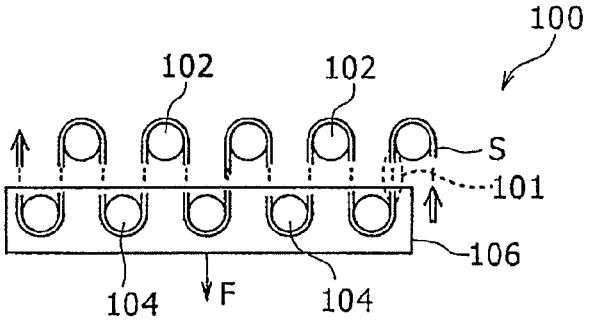
FIG. 14A illustrates an example prior art accumulation device.
Figure 14B:
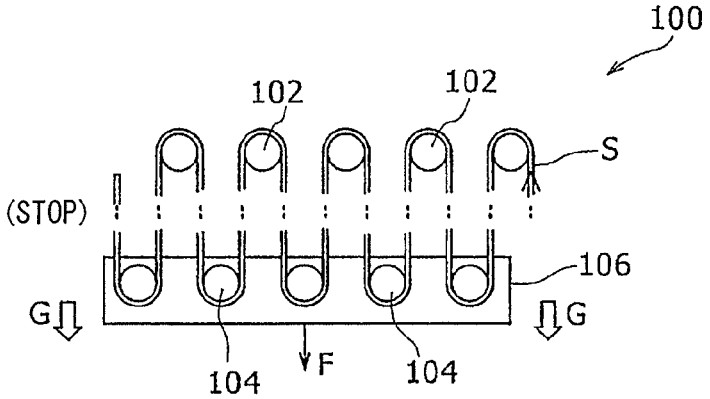
FIG. 14B illustrates the outfeed stop state.
Figure 14C:
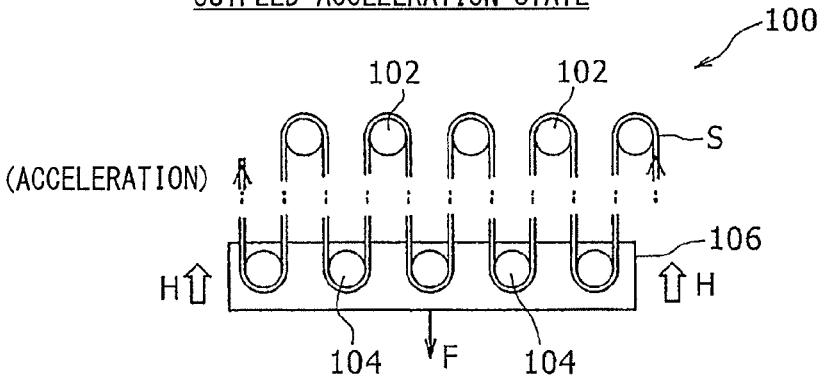
FIG. 14C illustrates the outfeed acceleration state.

Further, when the substrate S is transported at a constant rate during the steady operation, a phenomenon may occur in which air is accumulated within the cylindrical substrate S to inflate the substrate S into a balloon shape at a location immediately before the lower rollers 56, as illustrated with dashed line 101 in FIG. 14. As this modification example accumulation unit 50*a* includes each lower roller 56 in an independent suspension system as described above, an increase in the pressure of the air accumulated in the cylindrical substrate S lifts the lower rollers 56 against the urging force of the elastic member 87, allowing the air within the substrate S to escape downward. Consequently, transportation troubles for the substrate S caused by accumulation of the air can be reduced.

The present invention is not limited to the embodiment and the modification example thereof described above. Various modifications and improvements may be made within the scope of matters described in the scope of the claims and within the equivalent scopes.

While in the above examples, during the accumulation operation of the accumulation units 50 and 50*a*, the set of upper rollers 54 is lifted while the set of lower rollers 58 is lowered to thereby increase the lengths of the substrate which can be accumulated, the present invention is not limited to this structure. For example, the set of upper rollers 54 may be fixedly disposed while only the set of lower rollers 58 is allowed to moved, or vice versa.

While in the above examples, the accumulation device 10 including the accumulation unit 50 or 50*a* having the set of upper rollers 54 and the set of lower rollers 58 that are moved upward and downward has been described, the present invention is not limited to this structure. The present invention may be applied, for example, to an accumulation device including a set of first rollers composed of a plurality of rotatable first rollers and a set of second rollers composed of a plurality of rotatable second rollers that are movable toward and away from the set of first rollers, in which the second set of rollers is moved relative to the first set of rollers in the horizontal direction or in the direction crossing the horizontal direction to thereby change the distance between the first and second sets of rollers.

Further, while in the above examples, the outfeed rate of the substrate is changed to perform control to maintain the movable roller 34 in the tensioning unit 30 at a constant height without performing the opening or closing operations of the accumulation unit 50 during the steady operation of the accumulation device 10, the present invention is not limited to these examples. For example, control may be performed to maintain the constant position of the movable rollers 34 of the tensioning unit 30 while performing the opening and closing operations of the accumulation unit 50 similar to the control in the accumulation operation.

Also, while in the above examples, the film processing system 1 including the accumulation device 10 between the processor 4 and the winding unit 5 has been described, the present invention is not limited to this structure, and may be applied to the label fitting system as described in Patent Documents 1 and 2. In this case, the accumulation device is disposed between the substrate feeding device, which is an upstream device, and the label fitting device, which is a downstream device. During the steady operation in which the label substrate is sent out from the substrate feeding device at a constant rate, the accumulation device is in an open state to accumulate the label substrate, and during temporary interruption of feeding of the label substrate associated with replacement of the substrate reel of the substrate feeding device, the accumulation device is closed and simultaneously outfeed of the label substrate which is accumulated is continued, thereby enabling continuous operation of the label fitting device. Further, in this case, it is preferable to perform control to maintain the constant height position of the movable rollers 34 of the accumulation unit 30 by changing the infeed rate of the infeed unit 20 for feeding the substrate fed from the substrate feeding device into the accumulation device during the steady operation of the accumulation device.

REFERENCE SIGNS LIST

1 film processing system
2 film supply unit
3 supply reel
4 processor
5 winding unit
6 winding reel
7 substrate winding amount detection sensor
10, 100 accumulation device
12, 14 fixed frame
20 infeed unit
22, 82 drive roller
24, 84 slave roller
26, 86 rotation rate detection sensor
30 tensioning unit
32 fixed roller
34 movable roller
36 support roller
38 support member
39 height position sensor
40 movable unit
42, 48 wire
44*a*, 44*b* support pulley
46 tension pulley
50, 50*a* accumulation unit
52 upper roller
54 set of upper rollers
56 lower roller
58 set of lower rollers
60 upper support member
61, 63 arm portion
62, 62*a* lower support member
64 drive mechanism
65L, 65U nut portion
68L lower gear
68U upper gear
69, 74 pulley
70, 75 belt
71 roller portion
72 shaft
73 bearing member
76 home position sensor
80 outfeed unit
86 rotation rate detection sensor
87 elastic member
88 movable member
89 coupling member
89*a* through hole
89*b*, 93 recess portion
90 controller
92 side wall portion
94 shaft member
95 stopper
Ft load
M1 infeed motor
M2 outfeed motor
M3 tensile force motor
M4 accumulator
S substrate
S1, S2, S3 signal

The invention claimed is:

1. An accumulation device, comprising:

an infeed unit configured to feed in a substrate;

an outfeed unit configured to feed out the substrate;

a tensioning unit disposed toward upstream in a transporting direction of the substrate between the infeed unit and the outfeed unit, the tensioning unit being configured to apply predetermined tensile force to the substrate;

an accumulation unit disposed downstream of the tensioning unit in the transporting direction of the substrate between the infeed unit and the outfeed unit, the accumulation unit being configured to accumulate a surplus of the substrate generated by a difference between a substrate infeed rate of the infeed unit and a substrate outfeed rate of the outfeed unit; and a controller configured to control an operation of each of the infeed unit, the outfeed unit, and the accumulation unit, wherein the tensioning unit includes a plurality of rotatable fixed rollers spaced from each other and arranged in parallel to each other, and at least one rotatable movable roller disposed in parallel to the fixed rollers, the at least one rotatable movable roller being movable toward and away from the fixed rollers, the substrate being transported while being wound alternately around the fixed rollers and the at least one movable roller, the tensioning unit is configured to apply the predetermined tensile force to the substrate by a force acting onto the movable roller in a direction away from the fixed rollers, and the controller is configured to maintain a constant position of the movable roller with respect to the fixed rollers of the tensioning unit.

2. The accumulation device according to claim 1, wherein the controller is configured to control a substrate accumulation operation of the accumulation unit during accumulation operation, to thereby maintain the constant position of the movable roller with respect to the fixed roller of the tensioning unit.

3. The accumulation device according to claim 1, wherein the controller is configured to control one of the substrate outfeed rate of the outfeed unit or the substrate infeed rate of the infeed unit during steady operation, to thereby maintain the constant position of the movable roller with respect to the fixed rollers of the tensioning unit.

4. The accumulation device according to claim 1, wherein the accumulation unit comprises a set of first rollers including a plurality of first rollers spaced from each other and disposed in parallel to each other, a set of second rollers including a plurality of second rollers, the plurality of second rollers being movable toward and away from the set of first rollers below the set of first rollers, and a drive mechanism configured to cause the set of first rollers and the set of second rollers to perform open and close operations to change a distance between the set of first rollers and the set of second rollers, wherein a substrate is transported while being wound alternately around the first rollers and the second rollers.

5. The accumulation device according to claim 4, wherein each of the first rollers and the second rollers includes a roller portion, and a shaft configured to rotatably support the roller portion via a bearing member, each of the first rollers and the second rollers further including a tendency mechanism configured to rotate the shaft at a rotation rate identical with a rotation rate of the roller portion in a rotation direction identical with a rotation direction of the roller portion.

6. The accumulation device according to claim 4, wherein the controller is configured to control the open and close operations to change a distance between the set of first rollers and the set of second rollers to maintain the constant position of the movable roller with respect to the fixed roller of the tensioning unit.

7. The accumulation device according to claim 4, wherein the drive mechanism includes a first ball screw for moving the set of first rollers, a second ball screw for moving the set of second rollers, a first gear fixed to the lower end of the first ball screw, a second gear fixed to the lower end of the second ball screw, the first gear and the second gear engaging with each other, a pulley coupled to a lower portion of the second gear concentrically, and an accumulation motor for driving and rotating the second gear and the pulley, wherein the drive mechanism is configured so that a torque acting on the first ball screw and a torque acting on the second ball screw work in directions cancelling each other in the engagement portion of the first gear and the second gear.

8. The accumulation device according to claim 4, wherein at least one of the second rollers is urged in a direction away from the set of first rollers by an elastic member provided to the one of the second rollers or by self-weight of the one of the second rollers and a movable member configured to support the one of the second rollers movably with respect to the support member.

9. The accumulation device according to claim 8, wherein the one of the second rollers urged in a direction away from the set of first rollers is disposed toward upstream in the transporting direction of the substrate in the set of second rollers.

10. The accumulation device according to claim 8, wherein each of the second rollers is urged independently from the other of the second rollers in the direction away from the set of first rollers by an elastic member provided to the each of the second rollers or by self-weight of the each of the second rollers and a movable member configured to support the each of the second rollers movably with respect to the support member.

11. The accumulation device according to claim 4, wherein at least one of the first rollers is urged in a direction away from the set of second rollers by an elastic member provided to the one of the first rollers.

12. The accumulation device according to claim 11, wherein each of the first rollers is urged independently from the other of the first rollers in the direction away from the set of second rollers by an elastic member provided to the each of the first rollers.

13. The accumulation device according to claim 1, wherein the tensioning unit comprises a mechanism for adjusting the load acting on the movable roller.

14. The accumulation device according to claim 13, wherein the tensioning unit comprises a tensile force motor, and the controller is configured to control the torque of the tensile force motor to adjust the load acting on the movable roller.

15. The accumulation device according to claim 13, wherein the tensioning unit comprises a weight and the load acting on the movable roller is adjusted by the weight.

* * * * *